US007152748B2

(12) United States Patent
Vosbikian

(10) Patent No.: US 7,152,748 B2
(45) Date of Patent: Dec. 26, 2006

(54) MERCHANDISE RACK DISPLAY SYSTEM

(75) Inventor: Peter S. Vosbikian, Moorestown, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 230 days.

(21) Appl. No.: 10/981,339

(22) Filed: Nov. 4, 2004

(65) Prior Publication Data

US 2006/0091092 A1 May 4, 2006

(51) Int. Cl.
*A47F 5/08* (2006.01)

(52) U.S. Cl. ..... 211/87.01

(58) Field of Classification Search ..... 211/87.01, 211/85.26, 181.1, 54.1, 57.1, 59.1
See application file for complete search history.

(56) References Cited

U.S. PATENT DOCUMENTS 4,344,540 A * 8/1982 Marschak ..... 211/106
4,702,380 A 10/1987 Herman
4,723,663 A * 2/1988 Learn ..... 211/59.2
4,944,390 A 7/1990 Baucom et al.
5,224,609 A 7/1993 Bauer et al.
5,303,830 A * 4/1994 Metcalf ..... 211/57.1
5,482,168 A * 1/1996 Welch et al. ..... 211/106
5,526,941 A * 6/1996 Ford ..... 211/59.1
5,785,187 A 7/1998 Lipman et al.
5,871,115 A * 2/1999 Kohn ..... 220/485
5,927,517 A 7/1999 Lipman et al.
6,089,387 A * 7/2000 Varfolomeeva ..... 211/181.1
6,299,001 B1 * 10/2001 Frolov et al. ..... 211/106
6,340,091 B1 1/2002 Romeo et al.

* cited by examiner

*Primary Examiner*—Sarah Purol
(74) *Attorney, Agent, or Firm*—Stuart M. Goldstein

(57) ABSTRACT

A merchandise rack display system uses a vertical pegboard surface onto which a uniquely designed rack component is to be mounted. The rack component has front and rear rack panels interconnected by support elements. A spaced opening between the front and rear panels permits the handles of elongated products, such as mops and brooms which are mounted and hung from the pegboard surface, to extend through the opening. The rack also has provision for mounting a variety of display hooks for hanging or suspending merchandise in various locations on the front panel of the rack. Container baskets, uniquely configured to be mounted on the rack, provide added versatility to the system.

16 Claims, 5 Drawing Sheets

MERCHANDISE RACK DISPLAY SYSTEM

BACKGROUND OF THE INVENTION

Products and merchandise in retail settings are displayed in a variety of different ways, including by the use of pegboard/hook display systems. Such systems generally consist of a stationary mounted planar pegboard which has spaced horizontal and vertical rows of holes, generally positioned at intervals of one to two inches. Cooperating bent wire hooks are configured at one end to be inserted in any given hole and, at the other end, to directly support products or merchandise. The hooks are removable and so they can be inserted in different holes, to vary the location and placement of the merchandise on the pegboard, depending on the size of the merchandise and the visual appearance required by the presentation of merchandise. The hooks which are used are formed in varied sizes and configurations, conditioned upon the size and shape of the merchandise to be displayed. Examples of these systems are found in U.S. Pat. Nos. 4,723,663, 5,224,609, 5,785,187, and 5,927,517. The systems disclosed in this prior art are largely directed to the display of individually mounted products.

Other systems employ product display racks in a variety of configurations, are also designed to be used in combination with pegboard systems. Examples of these are shown in U.S. Pat. Nos. 4,944,390 and 6,340,091. However, these racks are specifically designed for and thus generally restricted to the display of one particular product.

The prior art does not contemplate a product rack display system which has the versatility to efficiently and effectively display many different types of merchandise in a vast variety of sizes and shapes and in a multitude of different product containers. The present invention allows product merchandise to be so displayed.

SUMMARY OF THE INVENTION

It is thus the object of the present invention to provide a merchandise rack display system which overcomes the limitations and disadvantages of prior systems.

It is an object of the present invention to provide a merchandise rack display system which allows product merchandise to be fully displayed in an attractive and organized manner on a single pegboard mounted display frame.

It is another object of the present invention to provide a merchandise rack display system which has the versatility to effectively and efficiently, using economy of space to display a variety of different merchandise.

It is still another object of the present invention to provide a merchandise rack display system which can display a great variety of merchandise of different sizes, shapes, and in a multitude of different product containers, in unlimited display configurations.

It is a further object of the present invention to provide a merchandise rack display system which uses a novel rack component in combination with a pegboard system and uniquely designed basket containers to obtain the product display versatility.

These and other objects are accomplished by the present invention, a merchandise rack display system which uses a vertical pegboard surface onto which a uniquely designed rack component is to be mounted. The rack component has front and rear rack panels interconnected by support elements. A spaced opening between the front and rear panels permits the handles of elongated products, such as mops and brooms which are mounted and hung from the pegboard surface, to extend through the opening. The rack also has provision for mounting a variety of display hooks for hanging or suspending merchandise in various locations on the front panel of the rack. Container baskets, uniquely configured to be mounted on the rack, provide added versatility to the system.

The novel features which are considered as being characteristic of the invention are set forth in particular in the appended claims. The invention itself, however, both as to its design, construction, and use, together with additional features and advantages thereof, are best understood upon a review of the following detailed description with reference to the accompanying drawings.

DETAILED DESCRIPTION OF THE INVENTION

Figure 1:
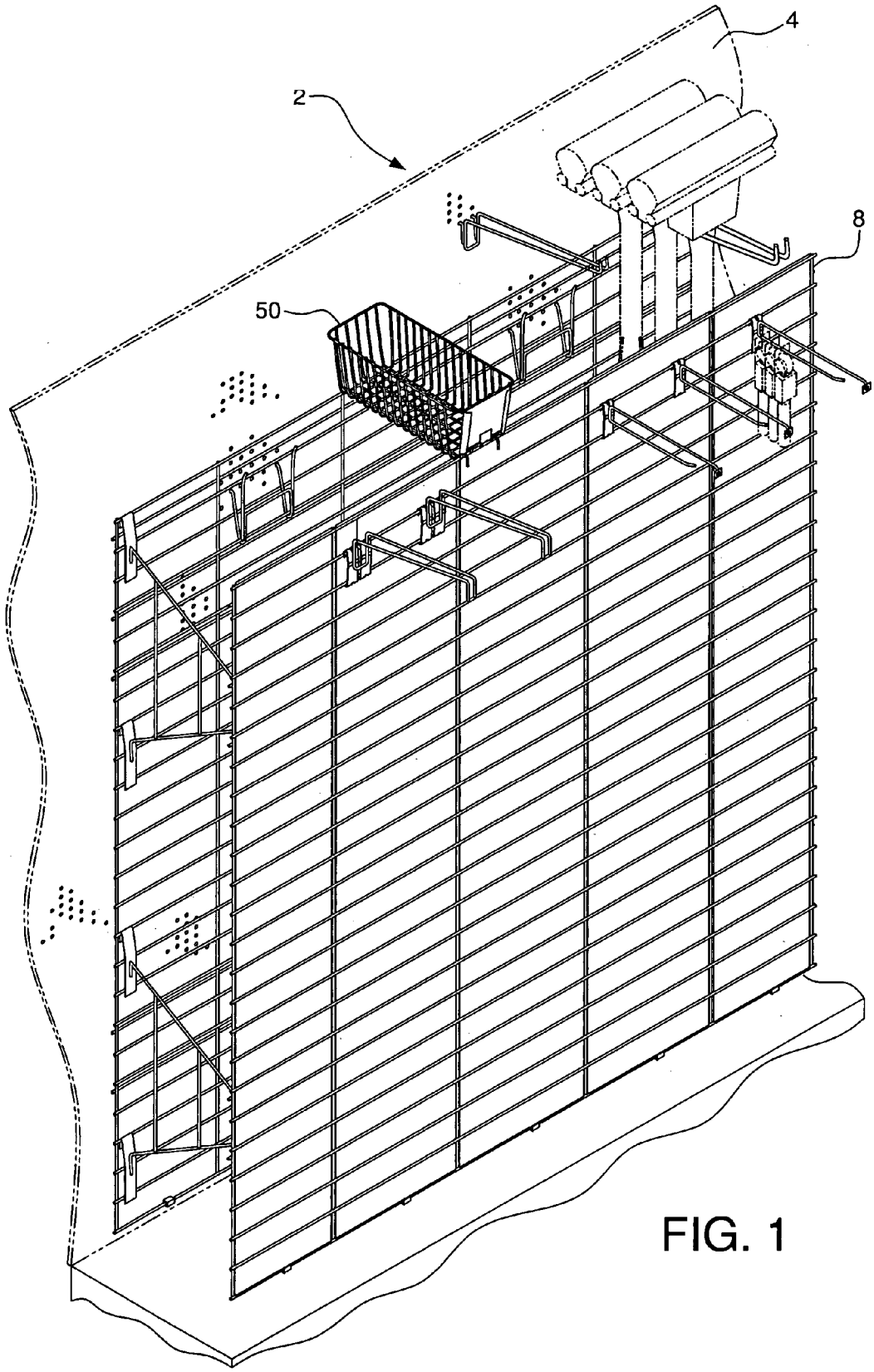
FIG. 1 is an isometric view showing the merchandise rack display system of the present invention.
Figure 2:
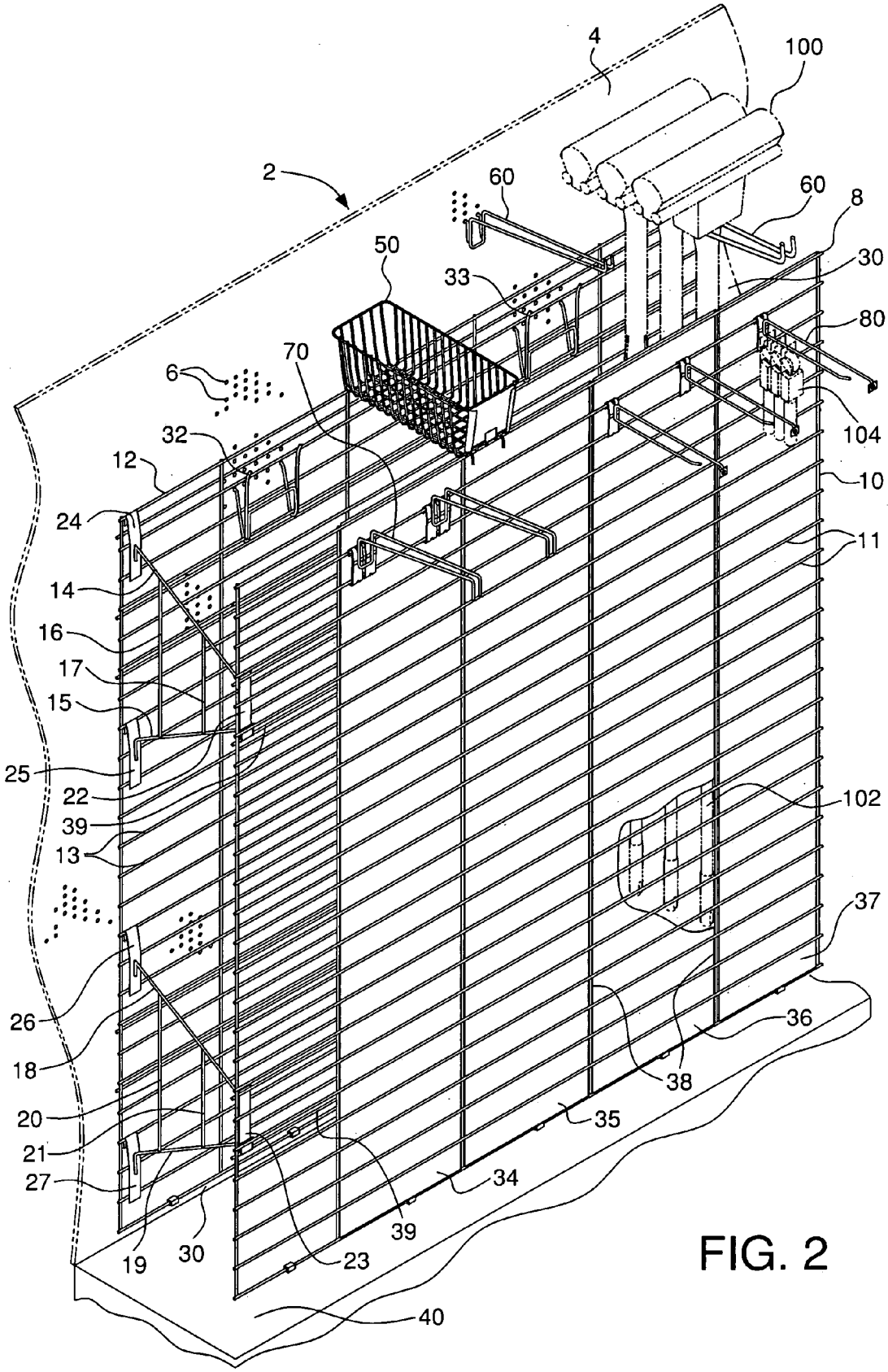
FIG. 2 is an isometric view, partly broken-away, showing the merchandise rack display system of the present invention.
Figure 3:
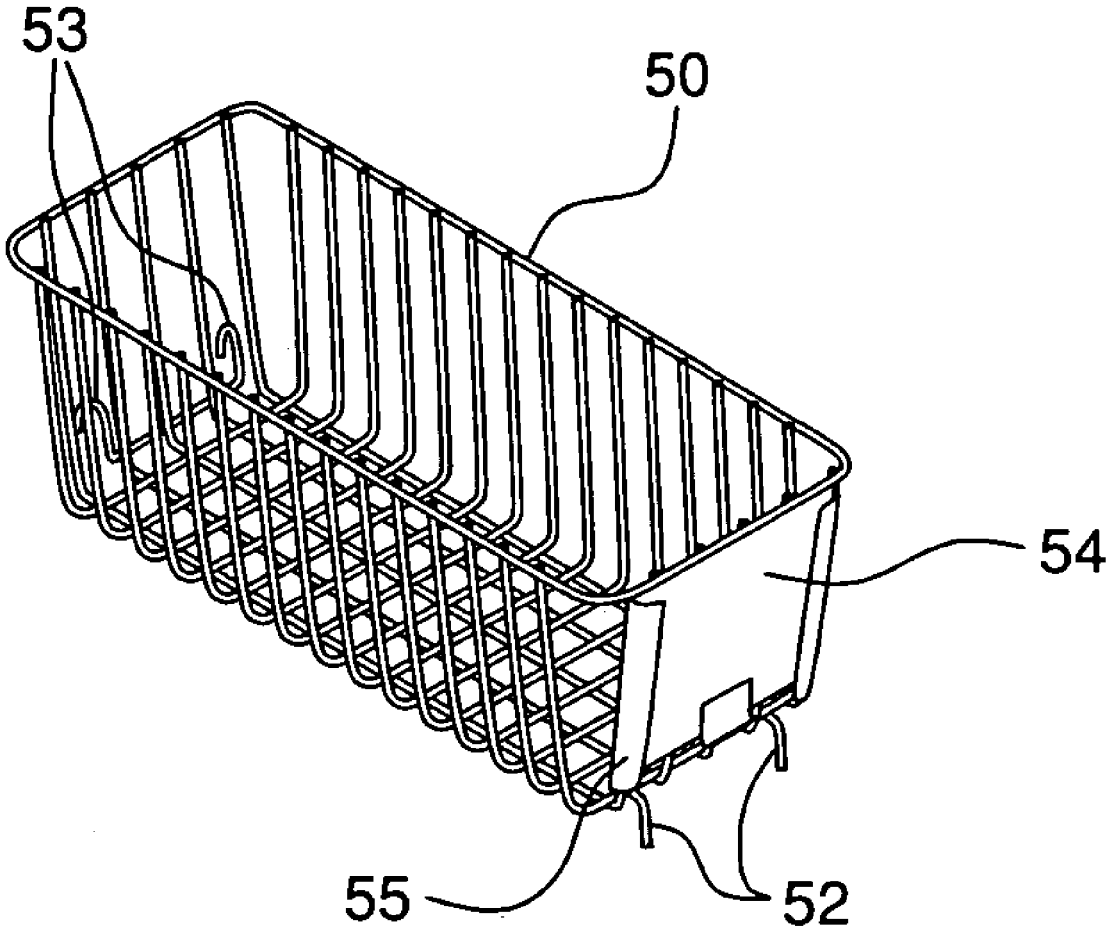
FIG. 3 is an isometric view showing the container basket of the merchandise rack display system of the present invention.

Merchandise rack display system 2 comprises vertically standing, stationary mounted pegboard 4 having a plurality of holes 6 which are arranged in vertical and horizontal rows, optimally spaced in one inch intervals, although the invention is not to be considered restricted by the spacing of the holes or type of pegboard being used. Display rack 8 comprises front panel 10 made up of spaced rail members 11 horizontally extending the width of panel 10, and rear panel 12 made up of spaced rail members 13 extending horizontally across the width of panel 12. Front panel 10 and rear panel 12 of rack 8 are interconnected by upper support members 14 and 15 and interconnecting brace supports 16 and 17 located near the upper sections of the panels and lower support members 18 and 19 and interconnecting supports 20 and 21 located near the lower sections of the panels.

Support members 14 and 15 are connected at their outboard ends to support plate 22 and support members 18 and 19 are connected at their outboard ends to support plate 23. Support plates 22 and 23 are secured by welding, brazing, or similar means to the back surface of front panel 10. The inboard ends of support members 14 and 15 are connected to plate hooks 24 and 25 and the inboard ends of support members 18 and 19 are connected to plate hooks 26 and 27. Each plate hook has a curved, unshaped upper end section.

FIG. 1 shows upper support members 14 and 15 and lower support members 18 and 19 with their respective brace supports, support plates and plate hooks located on the left side of rack 8. Identical support components are located on the right side of the upper and lower sections of panels 10 and 12 of rack 8.

The curved ends of plate hooks 24 and 25 at the ends of support members 14 and 15 are hooked onto two rail members 13 of rear panel 12; and the curved ends of plate hooks 26 and 27 at the ends of support members 18 and 19 are hooked onto two other rail members 13 of rear panel 12. As discussed above, the identical support components interconnect panels 10 and 12 on the right side of rack 8.

The interconnecting configuration of upper support members 14 and 15 and lower support members 18 and 19 and the identical support components on the right side of rack 8, result in front panel 10 being well-supported in spaced relation to rear panel 12. It is also seen that space 30 is formed between panels 10 and 12.

Rear panel 12 of assembled rack 8 is hooked onto pegboard 4 by means of hook members 32 and 33 inserted into and extending from pegboard holes 6. Rail members 13 are positioned on hooks 32 and 33 to support rear panel 12 and hence rack 8 in vertical relation to pegboard 4.

By this design, the entire assembled rack 8 can be removed from pegboard 4 by unhooking rear panel 12 from hook members 32 and 33 on the pegboard. Rack 8 can then be re-positioned anywhere on pegboard 4, including above a surface, like platform 40, which would allow merchandise to be placed on the platform, below the rack. Alternatively, plate hooks 24, 25, 26, and 27 and those identical plate hooks on the right side of rack 8 can be unhooked from rear panel 12, if it is desired or necessary to remove only front panel 10 of the rack.

Cardboard, plastic, or like rigid material inserts 34, 35, 36, and 37 can be inserted between vertical rail members 38 of panel 10 and in front of horizontal rail members 39 which are attached to and traverse behind panel 10. The inserts can provide manufacturer/seller signage for the merchandise being displayed.

Container basket 50 is configured to be positioned and mounted over rail members 11 and 13 of panels 10 and 12 respectively. Front hook legs 52 and rear hook legs 53 of basket 50 extend over the rail members. Hook legs 52 and 53 are configured to allow basket 50 to be placed both over the topmost rail member or on the second rail member of panels 10 and 12. Front face 54 of basket 50 comprises receptacle 53 for receiving a signage insert, once again identifying the product being displayed and stored in the basket. Of course, several baskets 50 can be used in the display system and the baskets are readily removable and re-positionable on rack 8, based on user preference.

Figure 4:
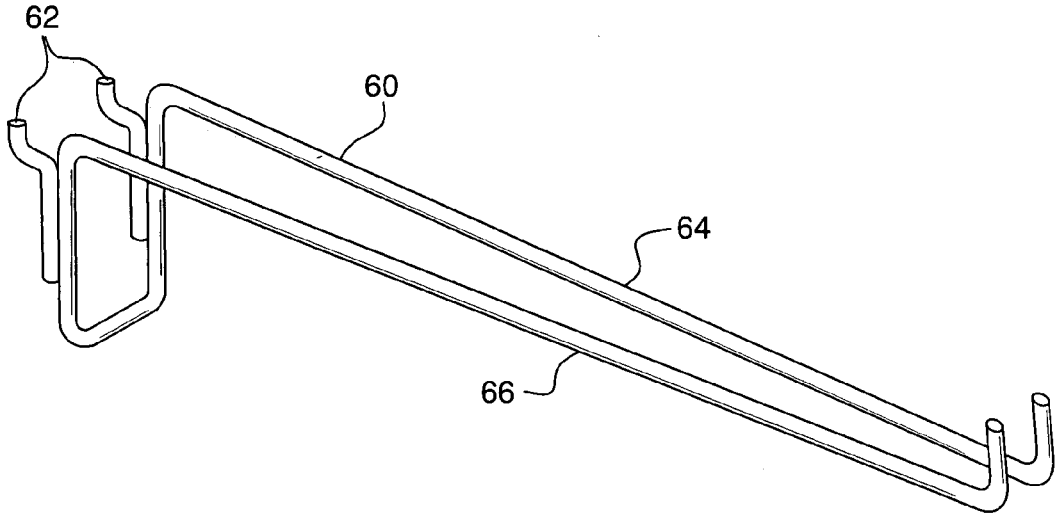
FIG. 4 shows a display mounting bracket used in the merchandise rack display system of the present invention.

Display mounting bracket 60, shown in FIG. 1 and more particularly in FIG. 4, consists of hooks 62 configured to be inserted into holes 6 of pegboard 4, and a pair of substantially horizontal, spaced elongated arm members 64 and 66, extending outwardly from hooks 62. Mounting bracket 60 is configured to support and suspend product merchandise with elongated handles, like mops 100.

When bracket 60 is mounted in the upper region of pegboard 4, elongated handles 102 of mops 100 extend from the bracket downwardly into space 30, formed by rack panels 10 and 12. It can thus readily be seen that by positioning bracket 60 in different locations on pegboard 4, a variety of different sized tools with elongated handles can be mounted on the pegboard and extend into space 30, without interfering with the other items being displayed on or in rack system 2.

Figure 5:
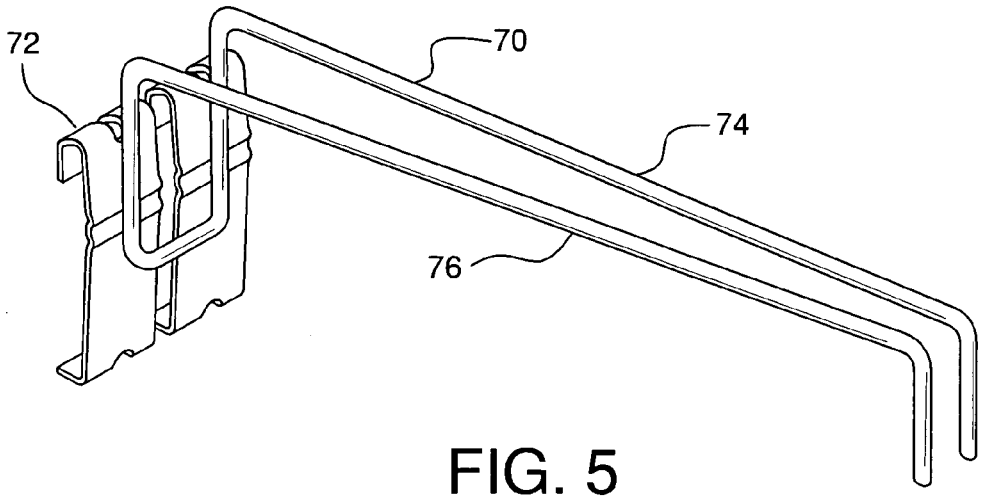
FIG. 5 shows another display mounting bracket used in the merchandise rack display system of the present invention.

FIG. 5 specifically shows alternate display mounting bracket 70, comprising base member 72 with curved upper and lower sections configured to mount onto and slide along intermediate rail members 11 of panel 10. Bracket 70 has a pair of horizontally spaced elongated arm members 74 and 76 which extend outwardly from base 72. Bracket 70 provides an alternate display tool which can be mounted on panel 10 to hang and display smaller tools with handles or other compatibly mounted products.

Figure 6:
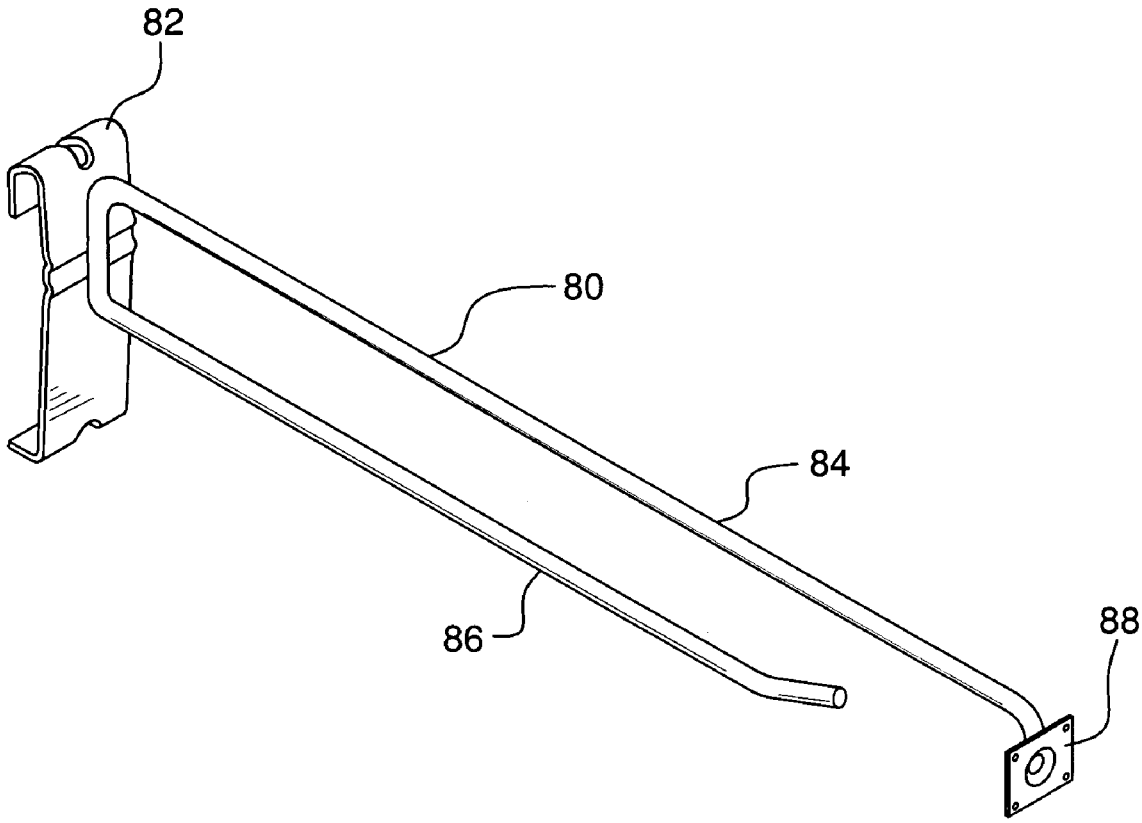
FIG. 6 shows still another display mounting bracket used in the merchandise rack display system of the present invention.

It is contemplated that display mounting bracket 80, particularly shown in FIG. 6, can also be used to display smaller tools with holed handles or tool and/or accessory containers. Bracket 80 consists of a base member 82 with curved upper and lower portions configured to mount onto and slide along intermediate rail members 11 of panel 10. Bracket 80 has a pair of vertically spaced, elongated arm members 84 and 86, extending outwardly from base 82. Arm members 84 and 86 accept product merchandise like packaged accessories 104, through openings in the merchandise or its packaging. At the end of arm 84 is plate 88, which can be used for mounting a label or other product signage.

It can thus be appreciated that when rack 8 is positioned and mounted on pegboard 4, an almost unlimited variety of product display configurations is possible. Mops 100 can be displayed in many different locations using brackets 60 with their elongated handles extending into and through space 30, between panels 10 and 12 of rack 8. The elongated handles of mops 100 can be positioned to extend between baskets 50, when these baskets are used with system 2. One or more baskets 50 can be used to hold mop accessories or other product items and moved and re-positioned on rack 8 as needed. Additionally, brackets 70 and 80 can be selectively placed on intermediate rails 11 of panel 10, depending on the merchandise to be displayed and the display configuration desired. These brackets, of course, can be repositioned, removed, or other brackets added, as necessary. As described above, the entire rack 8 can be removed from pegboard 4 and repositioned or placed on another pegboard system.

The components of merchandise rack display system 2 make this system highly versatile, presenting an efficient and attractive way to display merchandise, while emphasizing economy of space.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A merchandise display system for displaying merchandise, including tools with elongated handles, said system comprising:

a. a substantially vertically standing pegboard surface;

b. a merchandise display rack, said rack comprising front panel means for mounting and displaying merchandise thereon, said panel means comprising a plurality of rail members forming an integral, one piece, elongated unitary display member configured to be separable as a single, integral unit from the display system, a rear panel means for connection to the pegboard surface, said rear panel means comprising an integral, one piece, elongated unitary member which extends from an upper section of the pegboard surface to a lower section of the pegboard surface, support means connecting the front panel means to the rear panel means, and through opening means between the front panel means and the rear panel means for insertion and positioning of the elongated handles of the tools; and c. means mounting the rack onto the pegboard surface.

2. The merchandise display system as in claim 1 further comprising container means for holding merchandise, said container means being removeably connected to and extending between the front and rear panel means.

3. The merchandise display system as in claim 1 further comprising means to display merchandise, said means being removeably connected to and extending from the front panel means.

4. The merchandise display system as in claim 1 further comprising means extending from the pegboard surface to support the tools with elongated handles on the surface and for supporting the elongated handles within the opening means.

5. The merchandise display system as in claim 1 further comprising means in the front panel means to mount and support merchandise signage.

6. The merchandise display system as in claim 1 wherein the rack is removable from the means mounting the rack to the pegboard surface to allow movement of the rack in relation to the pegboard surface.

7. A merchandise display system for displaying merchandise, including tools with elongated handles, said system comprising:

a. a substantially vertically standing pegboard surface;

b. a merchandise display rack comprising a front display panel said display panel comprising a plurality of rail members forming an integral, one piece, elongated unitary display member configured to be separable as a single, integral unit from the display system, and a rear mounting panel positioned in spaced relation to the front panel, said rear mounting panel comprising an integral, one piece, elongated unitary member which extends from an upper section of the pegboard surface to a lower section of the pegboard surface, the front and rear panels forming an opening therebetween, and support means connecting the front panel to the rear panel; and c. means mounting the rack onto the pegboard surface.

8. The merchandise display system as in claim 7 further comprising container means for holding merchandise, said container means being removeably connected to and extending between the front and rear panel means.

9. The merchandise display system as in claim 7 further comprising means to display merchandise, said means being removeably connected to and extending from the front display panel.

10. The merchandise display system as in claim 7 further comprising means extending from the pegboard surface to support tools with elongated handle on the surface and for supporting the elongated handles within the opening.

11. The merchandise display system as in claim 7 further comprising means in the front display panel to mount and support merchandise signage.

12. The merchandise display system as in claim 7 wherein the rack is removable from the means mounting the rack to the pegboard surface to allow movement of the rack in relation to the pegboard surface.

13. The merchandise display system as in claim 1 wherein said front panel means is substantially parallel to the rear panel means.

14. The merchandise display system as in claim 1 wherein said front panel means is substantially parallel to the pegboard surface.

15. The merchandise display system as in claim 1 wherein said front display panel is substantially parallel to the rear mounting panel.

16. The merchandise display system as in claim 1 wherein the front display panel is substantially parallel to the pegboard surface.

* * * * *